US006016747A

United States Patent [19]

Beduhn et al.

[11] Patent Number: 6,016,747

[45] Date of Patent: Jan. 25, 2000

[54] PRINTING PRESS COUPLER ACCUMULATOR

[75] Inventors: Gregory M. Beduhn, Rodney; David G. Sandison, Grant, both of Mich.

[73] Assignee: BecMar Corp., Bailey, Mich.

[21] Appl. No.: 09/212,814

[22] Filed: Dec. 16, 1998

[51] Int. Cl.[7] ..... B41F 3/14; B65H 1/22

[52] U.S. Cl. ..... 101/177; 101/240; 270/58.3; 270/58.33; 271/270; 271/151; 414/793

[58] Field of Search ..... 101/177, 236, 101/237, 238, 239, 240, 241; 270/45, 1.01, 1.8, 58.3, 58.33; 271/270, 151, 182, 216, 218; 414/793, 796.18

[56] References Cited

U.S. PATENT DOCUMENTS

| | | | |
|---|---|---|---|
| 4,136,865 | 1/1979 | Marass | 271/270 |
| 4,311,475 | 1/1982 | Imai | 271/218 |
| 4,369,959 | 1/1983 | Hornbucke | 271/151 |
| 4,580,773 | 4/1986 | Minkle | 271/103 |
| 4,616,815 | 10/1986 | Vijuk | 270/45 |
| 4,766,810 | 8/1988 | Alt | 101/240 |
| 4,905,977 | 3/1990 | Vijuk | 270/45 |
| 5,033,729 | 7/1991 | Struthers | 271/151 |
| 5,235,907 | 8/1993 | Hirata | 101/240 |
| 5,256,028 | 10/1993 | Winski | 414/796.8 |
| 5,372,066 | 12/1994 | Proctor | 101/118 |
| 5,404,806 | 4/1995 | Proctor | 101/118 |
| 5,479,856 | 1/1996 | Wirz | 101/177 |
| 5,809,878 | 9/1998 | Proctor | 101/124 |
| 5,868,838 | 2/1999 | Le Riche | 270/58.33 |

*Primary Examiner*—Eugene Eickholt
*Attorney, Agent, or Firm*—Price, Heneveld, Cooper, DeWitt & Litton

[57] ABSTRACT

A sheet accumulator for advancing successive sheets between first and second color printing presses comprising an accumulator sheet conveyor for advancing sheets from one press to the other press, a sheet lifter at the conveyor to lift a first sheet and thereby enable the sheet conveyor to advance a second sheet beneath the first sheet, and a sheet sensor at the conveyor, operably associated with the sheet lifter to actuate and deactuate the sheet lifter based on the position of the sheet.

22 Claims, 3 Drawing Sheets

PRINTING PRESS COUPLER ACCUMULATOR

BACKGROUND OF THE INVENTION

This invention relates to a sheet accumulator, and to successive printing presses combined with an intermediate sheet accumulator to produce printed sheets of two or more colors.

The use of two color printing presses, such as stencil screen presses, in sequence to produce two color prints is old. Each press is a functional stage of operation. Each press typically has a dryer, e.g., a UV dryer, to rapidly dry the printed ink from that press before the next functional stage is encountered. To do this, the presses have been known to be put in synchronous drive with each other as with a jack shaft. Unfortunately, the actual processing of the sheets in the first press might get out of synchronism with the processing in the second press for various reasons. For example, if the first press runs out of sheet stock, it has to be stopped temporarily to be reloaded. To continue to run it would cause ink to pass through the stencil screen and be deposited on the equipment. If the first press is stopped and the two presses are synchronously interlocked, the second press will stop. However, since the second press will likely have stock in its dryer, the dryer will quickly overheat the sheet stock to potentially cause a fire. If the second press is caused to continue running, as to prevent stock overheating, it will soon run out of stock from the first press and deposit ink on the equipment. Alternatively, if the second press needs to be stopped for some operational reason, the continued output of sheet stock from the first press will quickly jam up at the discharge end of the first press, causing loss of product and other significant problems. If the first press is stopped simultaneously with stoppage of the second press, the sheet product of the first press will be stalled in the dryer, creating an overheating and potential fire problem. Furthermore, if there are three or more colors to be applied to each sheet, the potential problems of trying to correlate the presses, or the potential costs of operating them independently, become even more magnified.

Consequently, sequential two color sheet printing presses have caused significant operational problems for those in the industry. In view of these problems, it is normally preferred to run each press and dryer independently, even though this requires performing each color printing as a separate operation and greatly increases the cost of printing.

SUMMARY OF THE INVENTION

The present invention provides a unique sheet accumulator for interconnecting successive printing presses, such that the printing presses can be simultaneously operated at the same synchronized output speed or at differing speeds, or either press can continue to operate while the other one is temporarily stopped, yet without the difficulties previously encountered. Thus, the first press can be stopped temporarily to restock it with sheet stock to be printed, while continuing operation of the second press; or the second press can be stopped temporarily while the first press continues to function, yet without the output from the first press jamming. The presses can be run at the same speed or somewhat different speeds, and the presses can also be temporarily run independently or stopped, as desired.

The accumulator has a sheet accumulator conveyor, a sheet stop, a sheet lifter which is preferably a suction head, for lifting the tail end of a sheet to allow a successive sheet to underlap it in shingle fashion, and a sensor such as a photoelectric eye to control actuation and deactuation of the lifter. Preferably a prefeed conveyor is employed downstream of the first press dryer and upstream of the accumulator conveyor so as to quickly remove sheets from the first dryer while the accumulator sheet conveyor is operated at a slower speed, to assure optimum underlap shingling of the sheets.

The accumulator is positioned between selected printing presses, specifically between a dryer for the first press and the infeed for the second press.

Additional presses can be successively positioned relative to the first and second presses to obtain three or more color prints. These successive presses and cooperative sheet accumulators can be added in modular fashion to produce the desired number of colors for the printed product.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
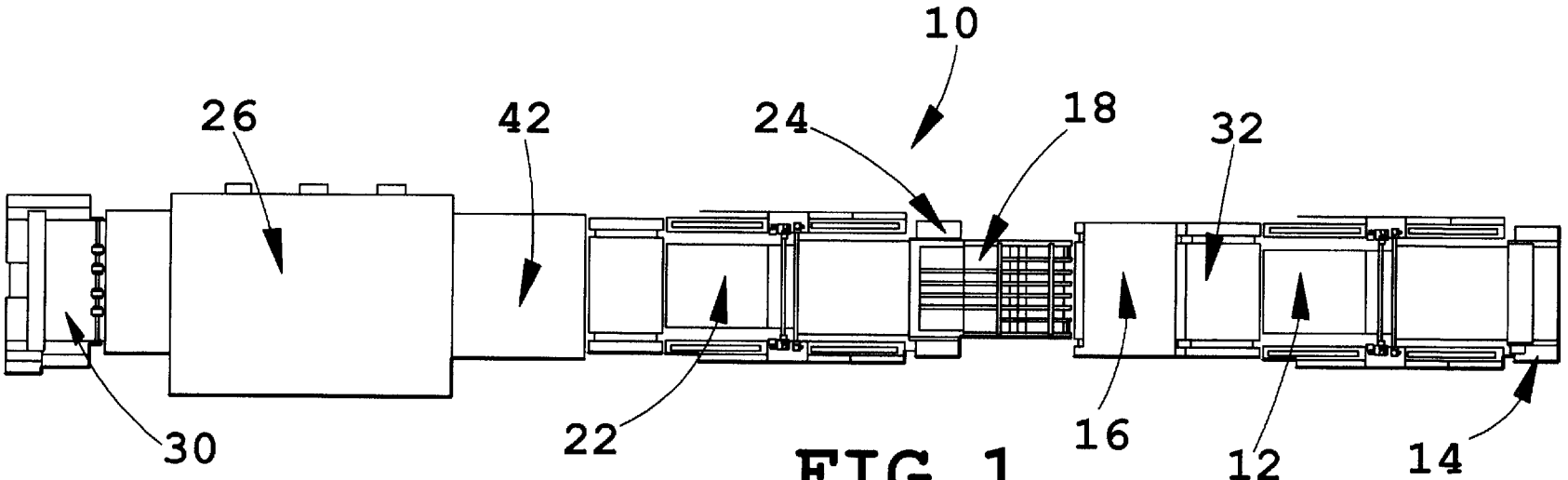
FIG. 1 is a plan view of a multiple press printing assembly employing this invention.

Referring now specifically to the drawings, the multiple press printing assembly 10 includes a first printing press 12, a first feeder 14 to cylinder press 12, a first dryer 16 downstream from press 12, a second printing press 22, a second feeder 24 to printing press 22, a second dryer 26. Between the two press and dryer subassemblies, and specifically downstream of the first dryer 16 and upstream of the second feeder 24, is the novel shingle accumulator 18. Optionally, downstream of the entire assembly is a conventional stacker jogger 30.

Each of the presses 12 and 22 may be of any conventional type, preferably stencil screen printing presses, of the type shown, for example, in U.S. Pat. No. 5,372,066 issued Dec. 13, 1994, which is incorporated by reference herein. Each press is capable of depositing ink in select locations on the sheet stock being advanced sequentially through the assembly. The ink is typically deposited by passing a squeegee over a stencil screen which allows passage of the ink through the screen only in select areas to produce the desired print pattern on the sheet stock. The two presses 12 and 22 will normally print different color inks to produce the desired effect on the final printed sheet stock. Two presses are shown in succession in this illustrative example. It will be understood that three or more presses may be used in sequence, depending on the number of colors desired to be printed.

The sheet stock is normally paper, but can be paperboard, plastic, metal, or other sheet stock materials to be printed for the desired final end use.

The feeders 14 and 24 are conventional in type, including known means for storing a limited quantity of sheet stock and advancing the individual sheets seriatim to the presses.

Figure 2:
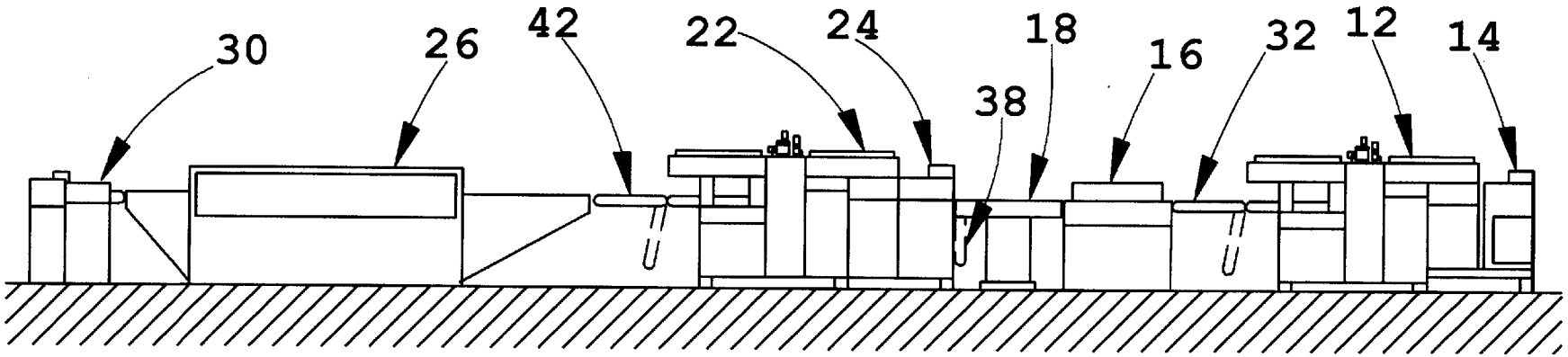
FIG. 2 is a side elevational view of the assembly in FIG. 1.
Figure 3:
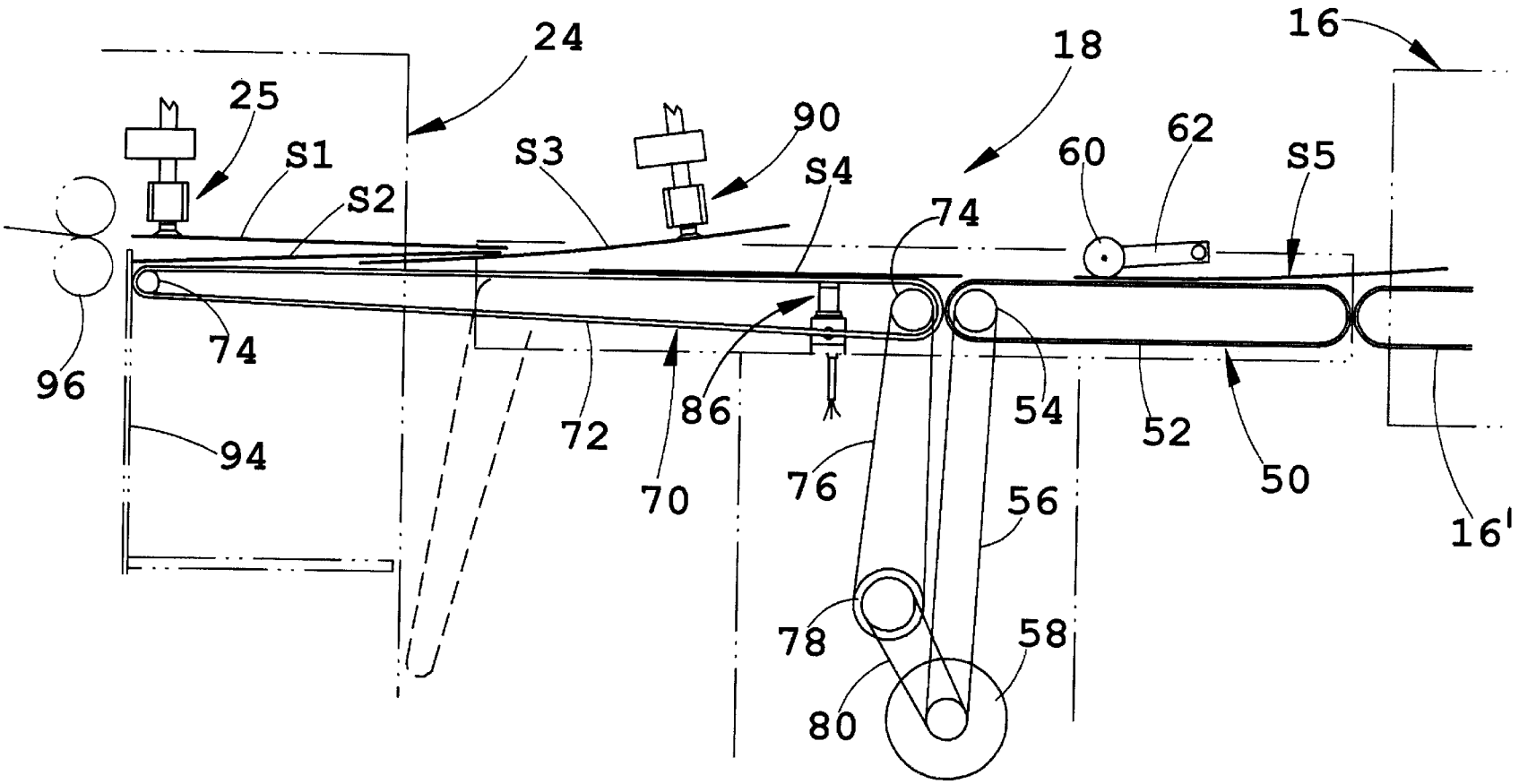
FIG. 3 is a side elevational view of the novel accumulator in the assembly of FIGS. 1 and 2.

The dryers 16 and 26 are of conventional type, such as UV dryers which dry the ink on the previously printed sheet stock as the printed sheets pass through the dryer on a conveyor in conventional fashion. The sheet stock normally has a time limit during which it can be retained in the dryer, particularly if the sheet stock is combustible. Dryer 26 preferably has a cooling zone following the drying zone. Optionally, a drop gate 32 can be located downstream of press 12 and upstream of dryer 16 so that, during nonoperational time periods, access can be had to the press and dryer mechanisms for adjustment, repair, or the like. Similarly, press 22 can include a drop gate 42. The drop gate can be pivotally mounted to move between the horizontal upright position depicted in FIG. 2 in solid lines, and the dropped lowered vertical position depicted in phantom lines in FIG. 2. Between the two press subassemblies, and specifically downstream of the first dryer 16 and upstream of the second feeder 24, is a shingle accumulator 18. Optionally, a drop gate 38 can be downstream of the shingle accumulator 18 to move from a horizontal orientation cooperative with feeder 24 and a dropped lowered orientation depicted in FIG. 2. Referring to FIG. 3, the accumulator assembly 18 is shown to include a prefeed conveyor 50 such as one or more belts 52 which are recirculated around a pair of spaced parallel rolls 54 driven by belt or chain 56 from motor 58. This conveyor receives sheet stock, i.e., substrate from the discharge conveyor 16' of first dryer 16. Preferably a tension wheel 60 positioned on a pivot arm 62 above belt 52 causes sufficient downward pressure on the sheet stock or substrate to assure driving engagement by belt 52 on the substrate or sheet stock. Downstream of prefeed conveyor 50 is accumulator conveyor 70 which comprises one or more belts 72 that travel around spaced parallel rollers 74 driven by a belt or chain 76 from a variable speed sheave 78 driven by belt 80 from motor 58. Sheave 78 allows the speed of conveyor 70 to be adjusted relative to the speed of conveyor 50. This conveyor advances successive sheets to a vertically oriented stop 94 which serves as a stock guide for press 22.

Adjacent the infeed end of conveyor 70 is a stock sensor 86, preferably in the form of a photoelectric eye. It is positioned and oriented to detect the presence of an advancing sheet fed from conveyor 50 onto conveyor 70.

Above conveyor 70, intermediate its ends and normally downstream from sensor 86, is a sheet lifter, preferably one or more sucker heads 90. Sensor 86 actuates sucker heads 90. These sucker heads are vertically shiftable so as to be lowered to engage the tail end of a sheet of stock, and then raised to elevate this tail end of the sheet to enable the successor sheet to pass therebeneath in interleaved or shingle fashion. The sheet lifter sucker heads are preferably of the type in U.S. Pat. No. 4,580,773 incorporated by reference herein. The controlled positioning of successive sheets by the accumulator enables the two presses to have different modes or speeds of operation.

At the downstream end of accumulator conveyor 70 is preferably a lifting mechanism such as another plurality of the same type of sucker heads 25 to engage the leading end of the forwardmost sheet of stock and lift it upwardly over the level of the stock guide vertical panel 94 for advancement of the sheet by conveyor 70 to shift the leading edge of the stock between the conveyor rolls 96 that feed the second press 22.

In explaining operation of the accumulator, a series of five substrates or sheets of stock are shown in FIG. 3 as S1, S2, S3, S4, and S5. Sheet S1 is shown with its leading edge having been engaged by sucker heads 25 and elevated above the level of the stock guide 94, ready to be advanced into the second printer 22. Sheet S2 is shown with its leading edge abutted against stock guide 94 and having its tail end above the forward portion of subsequent sheet S3 to be interleaved in shingle fashion. Subsequent sheet S3 is shown with its forward end interleaved beneath sheet S2 and its tail end momentarily elevated by sucker 90 to allow the forward end of subsequent sheet S4 to be conveyed beneath the tail end of sheet S3 in shingle fashion. Sheet S4 is shown above sensor 86, having been transferred from prefeed conveyor 50 to accumulator conveyor 70, and its leading edge having actuated sensor 86 which in turn actuated lifter suckers 90. Sheet S5 is shown being discharged from the first dryer conveyor 16' and engaged by wheel 60 to be advanced by prefeed conveyor 50.

During the printing process, and as the sheets which have been printed on the first press 12 advance to the accumulator 18, each sheet is transferred from the first dryer conveyor 16' to prefeed conveyor 50 and hence to accumulator conveyor 70 to be moved toward the stock guide 94. Successive sheets are specially accumulated to prevent jam up because, as each sheet is transferred from conveyor 50 to conveyor 70, its leading edge is detected by sensor 86 which actuates lifter sucker heads 90 to release the tail end of the previous sheet. As the tail end of a sheet passes sensor 86, the lifter sucker head 90 is actuated to allow the sucker head to pick up the tail edge of this sheet.

Consequently, if the second printing press is temporarily shut down for some reason, the output from the first press will not jam up and cause damage and will not remain in the first dryer too long to create a potential fire hazard. Similarly, if the first press is shut down temporarily in order to reload print stock, for example, the second press can continue to feed sheets from the accumulator. Both presses may be shut down simultaneously if desired, or may be run independently. If the first press feeds sheet output at a different rate than the second press, the accumulator accommodates the differential. Thus, it may be desired to have the first press operate slightly faster than the second press, creating a temporary organized backlog at the accumulator, following which the first press may be shut down to reload print stock and during which the accumulator allows steady infeed to the second press.

Figure 4:
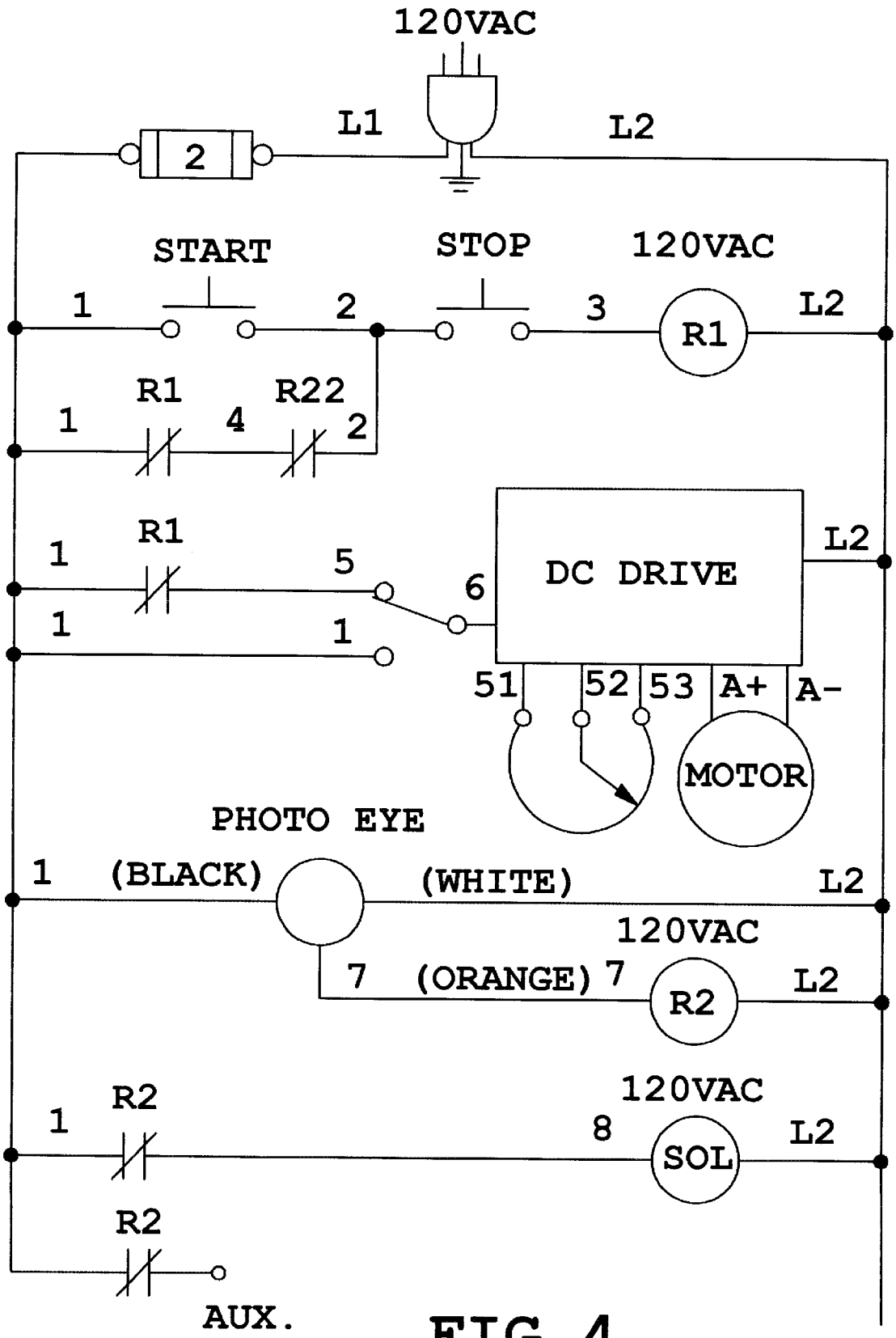
FIG. 4 is a circuit diagram of the control system for the assembly.

In FIG. 4 is an example circuit diagram for the control system. The shingle accumulator control system is shown to contain the following electrical components, main drive motor 58 (120 vac), photo eye sensor 86 (120 vac), and an air piloted solenoid vacuum valve (120 vac). The accumulator operates between the two presses 12 and 22 and is controlled in automatic mode by press 22 through relay R22. When relay R22 is energized, power is delivered to the DC drive and energizes the main drive motor. The main drive motor rotates the conveyor belts on the accumulator that transfer the sheet. When the sheet passes over the electric eye 86, relay R2 energizes, de-energizing the solenoid vacuum valve. The solenoid vacuum valve is located between a vacuum generator and the suckers on the sucker head 90 and closes to turn off vacuum at the sucker head. After the sheet has passed over the electric eye, relay R2 de-energizes, energizing the solenoid vacuum valve, causing the sucker head to pick up the tail end of the substrate, i.e., sheet. Relay R2 remains de-energized until the next sheet of substrate passes over the electric eye causing relay R2 to energize de-energizing the solenoid vacuum valve, allowing the tail of the first sheet to fall on the leading edge of the second sheet, completing the cycle. Relay R22 is controlled through a timer on press 22. When the press stops, R22 remains energized for one minute.

When operating the accumulator in manual mode, relay R22 is not energized. To operate the accumulator, the start button is engaged, energizing relay R1 to energize the DC drive. Engaging the stop button de-energizes relay R1.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

What is claimed is:

1. A sheet accumulator for advancing successive sheets between first and second functional stages operable at different rates, comprising:

an accumulator sheet conveyor for advancing sheets from one functional stage to another, and having an infeed end and a discharge end;

a sheet stop spaced from said infeed end;

a sheet lifter at said conveyor to lift a first sheet and thereby enable said sheet conveyor to advance a second sheet beneath said first sheet; and a sheet sensor at said conveyor and operably associated with said sheet lifter to actuate and deactuate said sheet lifter based on the position of a sheet.

2. The sheet accumulator in claim 1 wherein said sheet sensor is a photoelectric eye sensor.

3. The sheet accumulator in claim 1 wherein said lifter comprises a suction head lifter.

4. The sheet accumulator in claim 1 including a sheet feeder adjacent said stop for feeding sheets to the second functional stage.

5. The sheet accumulator in claim 1 including a prior sheet prefeed conveyor for advancing sheets to said accumulator sheet conveyor.

6. The sheet accumulator in claim 5 wherein said prior sheet prefeed conveyor functions to advance sheets at a slower rate than said accumulator conveyor.

7. The sheet accumulator in claim 1 wherein said sensor is operably associated with said lifter to actuate said lifter to lift the rear portion of said first sheet to allow said second sheet to be fed beneath said first sheet in underlap shingle fashion.

8. Combination first and second printing presses and a sheet accumulator therebetween for advancing successive sheets between said first and second printing presses, comprising:

a first printing press;

a second printing press;

a sheet conveyor between said first and second printing presses for advancing sheets from said first printing press to said second printing press, and having an infeed end and a discharge end;

a sheet stop spaced downstream from said infeed end;

a sheet lifter at said conveyor to lift a first sheet and thereby enable said sheet conveyor to advance a second sheet beneath said first sheet; and a sheet sensor at said conveyor and operably associated with said sheet lifter to actuate and deactuate said sheet lifter based on the sensing of a sheet.

9. The sheet accumulator in claim 8 wherein said sheet sensor is a photoelectric eye sensor.

10. The sheet accumulator in claim 8 wherein said lifter comprises a suction head lifter.

11. The sheet accumulator in claim 8 including a sheet feeder adjacent said stop for feeding sheets to said second printing press.

12. The sheet accumulator in claim 8 including a prefeed sheet conveyor for advancing sheets to said accumulator sheet conveyor.

13. The sheet accumulator in claim 12 wherein said prefeed sheet conveyor advances sheets at a slower rate than does said accumulator conveyor.

14. The sheet accumulator in claim 8 wherein said sensor is operably associated with said lifter to actuate said lifter to lift the rear portion of said first sheet to cause said second sheet to be fed by said accumulator conveyor beneath said first sheet in underlap shingle fashion.

15. A printing press sheet accumulator comprising:

a prefeed conveyor comprising first feeder belts for advancing sheets;

second feeder belts having an infeed end positioned to receive sheets from said first feeder belts;

a sheet stop spaced downstream from said infeed end;

a sheet lifter above said second feeder belts to momentarily lift a first sheet and thereby enable said second feeder belts to advance another sheet beneath said first sheet, whereby said sheets can thereafter be successively fed beyond said sheet stop; and a sheet sensor at said second feeder belts, operably associated with said sheet lifter to actuate and deactuate said lifter based on the position of a sheet.

16. Two color printing presses and an intermediate sheet accumulator, comprising:

a first color sheet printing press including a dryer and a sheet discharge;

a second color sheet printing press including a sheet infeed;

a sheet accumulator between said sheet discharge and said sheet infeed comprising:

an accumulator sheet conveyor for advancing sheets received from said first color sheet printing press to said second color sheet printing press, and having an accumulator infeed end and an accumulator discharge end;

a sheet lifter positioned at said accumulator sheet conveyor for lifting the tail end of a first sheet and thereby enabling said conveyor to advance a second sheet beneath said first sheet; and a sheet sensor at said conveyor, operably associated with said sheet lifter to actuate and deactuate said sheet lifter based on the position of said sheet.

17. The sheet accumulator in claim 16 wherein said sheet sensor is a photoelectric eye sensor.

18. The sheet accumulator in claim 16 wherein said lifter comprises a suction head lifter.

19. The sheet accumulator in claim 16 wherein said sheet infeed for said second press comprises a second sheet lifter adjacent said stop for feeding said second color press.

20. The sheet accumulator in claim 16 including a prefeed sheet conveyor for advancing sheets to said accumulator conveyor.

21. The sheet accumulator in claim 16 wherein said prefeed sheet conveyor advances sheets at a slower rate than said accumulator conveyor.

22. The sheet accumulator in claim 16 wherein said sensor actuates said lifter to lift the rear portion of said first sheet to enable said second sheet to be fed beneath said first sheet in underlap shingle fashion.

* * * * *